US009551551B2

(12) United States Patent
Ilacqua

(10) Patent No.: US 9,551,551 B2
(45) Date of Patent: Jan. 24, 2017

(54) UNIVERSAL FIREARM SCOPE LENS COVER

(71) Applicant: Applied Mechanical Technologies, Inc., Rochester, NY (US)

(72) Inventor: Anthony Ilacqua, Rochester, NY (US)

(73) Assignee: APPLIED MECHANICAL TECHNOLOGIES INC, Rochester, NY (US)

( * ) Notice: Subject to any disclaimer, the term of this patent is extended or adjusted under 35 U.S.C. 154(b) by 0 days.

(21) Appl. No.: 14/571,978

(22) Filed: Dec. 16, 2014

(65) Prior Publication Data

US 2015/0168103 A1 Jun. 18, 2015

Related U.S. Application Data

(60) Provisional application No. 61/916,428, filed on Dec. 16, 2013.

(51) Int. Cl.
*F41G 1/38* (2006.01)

(52) U.S. Cl.
CPC ..... *F41G 1/383* (2013.01)

(58) Field of Classification Search
CPC ..... F41G 1/38; F41G 1/383; F41G 1/04; F41G 1/065; F41A 35/02
USPC ..... 42/143, 129; 396/448; 359/511
See application file for complete search history.

(56) References Cited

U.S. PATENT DOCUMENTS

| | | | | |
|---|---|---|---|---|
| 2,522,897 | A * | 9/1950 | Rotter | F41G 1/383 220/264 |
| 2,599,689 | A * | 6/1952 | Brelsford | F41A 35/02 359/511 |
| 2,972,190 | A * | 2/1961 | Vissing | F41G 1/383 359/511 |
| 5,495,676 | A | 3/1996 | Chesnut et al. | |
| 5,561,563 | A | 10/1996 | Chesnut et al. | |
| 6,811,268 | B2 * | 11/2004 | Watson | F41G 1/383 359/511 |
| 7,585,080 | B2 | 9/2009 | Ballard | |
| 7,647,721 | B1 * | 1/2010 | Gaber | F41G 1/065 359/511 |
| 7,721,480 | B2 | 5/2010 | Campeau | |
| 2006/0098307 | A1 * | 5/2006 | Campean | F41G 1/383 359/819 |
| 2011/0249335 | A1 * | 10/2011 | Strawderman | G02B 23/16 359/511 |

FOREIGN PATENT DOCUMENTS

| | | |
|---|---|---|
| WO | 95/29377 | 11/1995 |
| WO | 99/42883 | 8/1999 |

* cited by examiner

*Primary Examiner* — Stephen M Johnson
*Assistant Examiner* — Benjamin Gomberg

(57) ABSTRACT

A lens cover for a firearm scope comprises a lens ring configured to mount to a lens, a cover bracket pivotally mounted to the lens ring, and a cover membrane disposed upon a portion of the lens ring and a portion of the cover bracket. When the cover bracket is in a closed position, the cover membrane creates a seal against the lens ring. The lens ring comprises an elastomeric material so as to enable mounting of the lens ring to lenses of differing diameters. The cover bracket includes a plurality of opposing mounting holes for selectively mounting the cover bracket to the adjustable lens ring.

9 Claims, 3 Drawing Sheets

UNIVERSAL FIREARM SCOPE LENS COVER

CROSS-REFERENCE TO RELATED APPLICATION

This application claims the benefit of Provisional Application U.S. Ser. No. 61/916,428 filed on Dec. 16, 2013.

BACKGROUND OF THE INVENTION

The present invention relates to a lens cover for use with a firearm scope, and more particularly relates to a flip-type lens cover for covering the ocular/eyepiece lens or the objective lens of a firearm scope, and still more particularly to a universal lens cover that can adjust to fit lenses of differing diameters.

Firearm scopes are well known telescopic sight mechanisms which are mounted to the top of a firearm (e.g., rifle, shot gun, hand gun, etc.) to allow the shooter to view distant objects for greater shooting accuracy. Typical scopes include a scope tube having opposing ends capped by a respective lens. Situated within and about the scope tube are various mechanisms which enable the user to adjust the optical magnification to set the desired magnification as well as to adjust the field focus to create a sharper image. However, no matter how advanced the magnification and focusing mechanics, a poor image will result should there be an accumulation of debris upon the eyepiece lens or objective lens, or should either lens be damaged or scratched in any manner. To minimize the possibility of contamination or damage to the lenses, a number of lens covers have been created. The following are some examples of prior art lens covers for protecting the lenses of a firearm scope:

U.S. Pat. No. 2,522,897 issued on Sep. 19, 1950 to Rotter

U.S. Pat. No. 5,495,676 issued on Mar. 5, 1996 to Chesnut, et al.

U.S. Pat. No. 5,561,563 issued on Oct. 1, 1996 to Chesnut et al.

U.S. Pat. No. 6,811,268 issued on Nov. 2, 2004 to Watson

U.S. Pat. No. 7,585,080 issued on Sep. 8, 2009 to Ballard

U.S. Pat. No. 7,721,480 issued on May 25, 2010 to Campean

PCT Patent Publication No. WO 99/42883 published on Aug. 26, 1999 to Xeyex Corporation.

While the above patents and patent applications illustrate various lens covers which are used in conjunction with a firearm scope, each have drawbacks including, for example, a complex design which translates into a high cost to manufacture, dependency on right or left hand use, complicated installation and use, designs which are susceptible to being easily damaged, designs which when employed obscure the downrange view of the user; and designs unable to accommodate lenses of differing diameters resulting in the requirement of multiple SKU's for the same lens cover type. As such, there remains a need for an improved lens cover for a firearm scope which overcomes the drawbacks of the prior art.

SUMMARY OF THE INVENTION

The present invention addresses the above need by providing a lens cover for a firearm scope which is relatively simple in design and thus low in cost yet is extremely robust and easy to use.

More particularly, in one aspect, the invention comprises a lens cover for a firearm scope which may be adjusted in size so as to fit lenses of differing diameters. The lens cover includes a lens ring fabricated from an elastomeric material or which includes an adjustable feature thereby allowing the lens ring to expand from a minimum diameter when the lens ring is in an unbiased state. The lens ring preferably expands to a point such that the internal diameter of the lens ring is equal to the external diameter of the lens (or lens casing). The expanded ring also provides sufficient tension to the lens/scope tube to secure the lens cover to the lens. The lens ring further includes a pair of opposing trunnions for pivotally mounting a cover bracket onto the lens ring. A cover membrane is secure to the lens ring and cover bracket such that when the cover bracket is disposed in a closed position, the cover membrane covers the lens ring thereby minimizing, and more preferably eliminating, contamination of and/or damage to the lens.

In another embodiment of the invention, the cover bracket includes a series of trunnion mounting holes thereby enabling the cover bracket to be selectively positioned upon the lens ring. The series of trunnion mounting holes allows the user to adjust the cover bracket mounting position such that the spacing between the cover bracket and the lens ring is minimized when the cover bracket is in either the open or closed positions. The cover bracket may further include extended bracket ends so as to provide sufficient surface area for thumb engagement and manipulation of the cover bracket to move the cover bracket between closed (lens covered) and open (lens uncovered) positions.

DETAILED DESCRIPTION OF PREFERRED EMBODIMENTS

Figure 1:
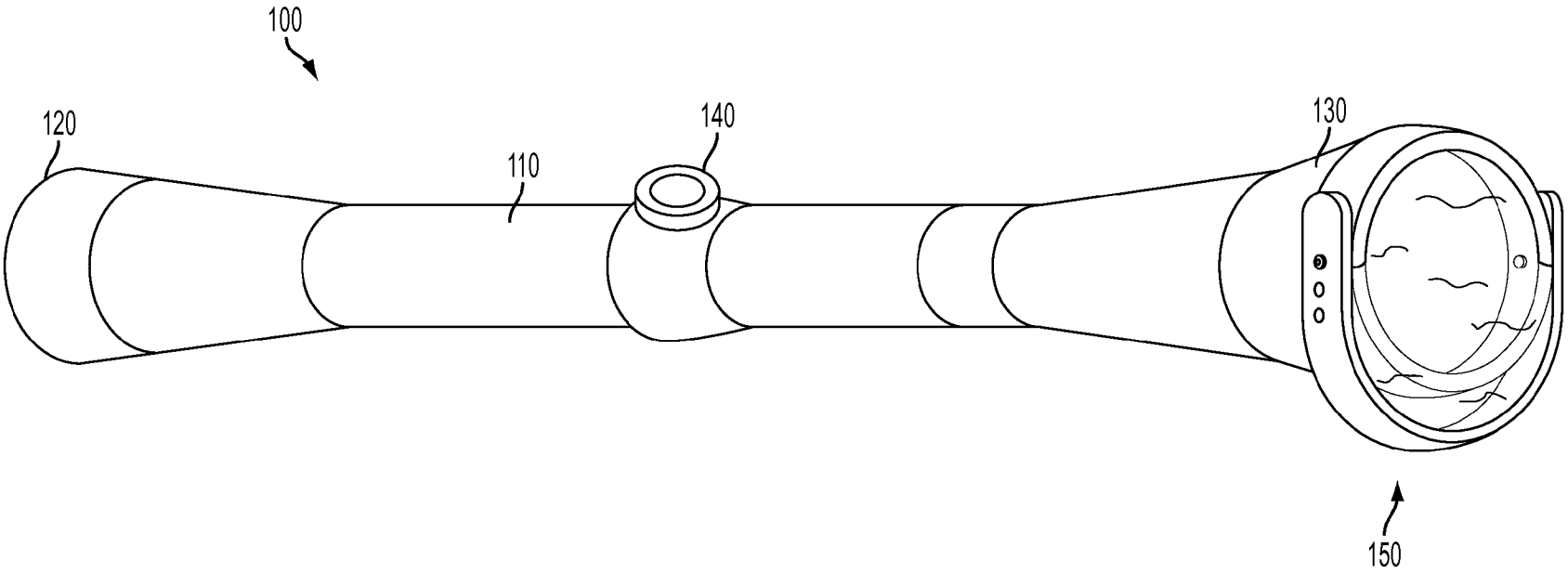
FIG. 1 is a perspective side elevation view of a firearm scope with a lens cover in accordance with an embodiment of the invention mounted thereto.

Referring to the drawings in detail, and specifically to FIG. 1, reference numeral 100 generally designates an exemplary firearm scope onto which has been mounted a lens cover 150 in accordance with an embodiment of the present invention. Firearm scope 100 typically has a scope tube 110 having an eyepiece lens 120 secured at one end of the tube and an objective lens 130 secured at the opposing end of the tube. The scope tube 110 further includes any number of view adjustment mechanisms (generally indicated by reference numeral 140), such as a power selector ring, eyepiece lock ring, and parallax, elevation and windage adjustment controls. These mechanisms allow the user to adjust the image magnification and image clarity. Although shown as being mounted onto objective lens 130, a lens cover 150 may also be mounted onto eyepiece lens 120.

Figure 3:
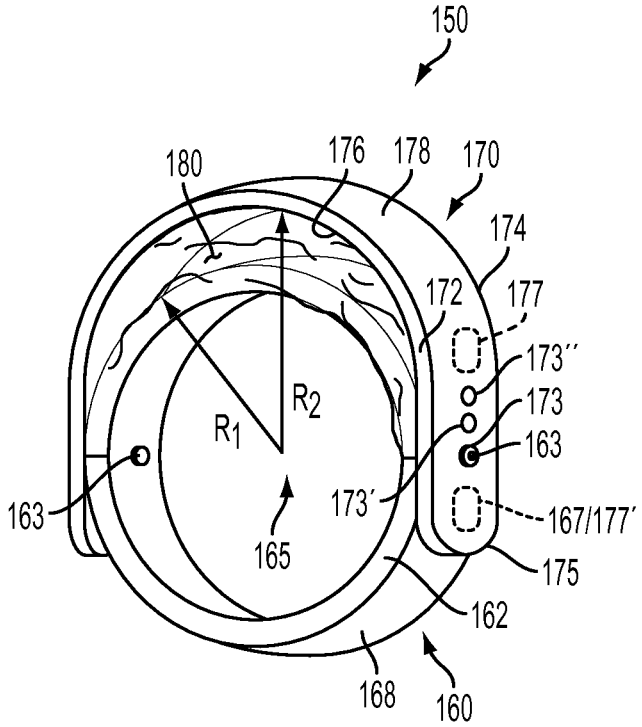
FIG. 3 is a perspective side view of an embodiment of the invention with a cover bracket in an open position.
Figure 4:
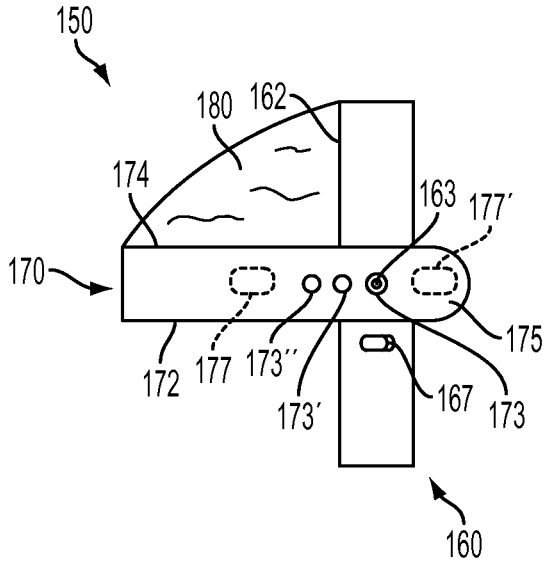
FIG. 4 is a perspective side view of an embodiment of the invention with a cover bracket in an intermediate position between an open position and a closed position.
Figure 5:
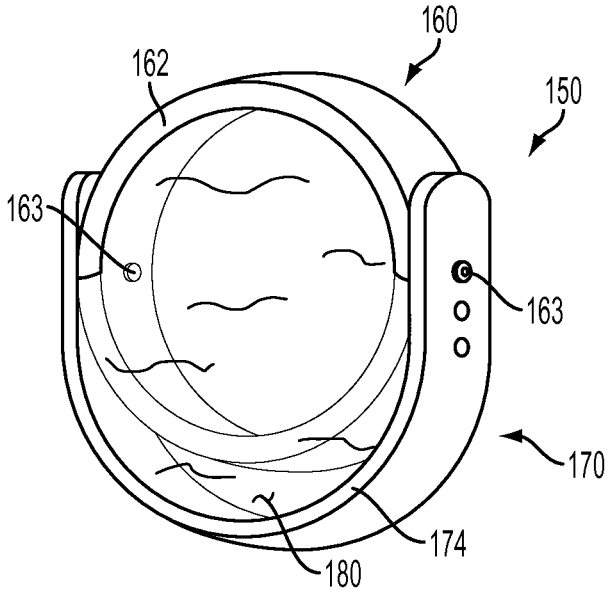
FIG. 5 is a perspective side view of an embodiment of the invention with a cover bracket in a closed position.

Turning now to FIGS. 2-5, lens cover 150 is generally configured to include of a cover bracket 170 pivotally connected to lens ring 160, there being a cover membrane 180 integrally formed on cover bracket 170 and lens ring 160. The cover membrane 180 is constructed such that when the cover bracket 170 is in the open position (see FIG. 3), the cover membrane 180 is gathered between the cover bracket 170 and the lens ring 160 so as to enable an unhindered view through ring opening 165. When the cover bracket 170 is pivoted to a closed position as shown in FIG. 5, cover membrane 180 covers front face 162 of lens ring 160.

In an alternative embodiment, not shown, lens ring 160 may seat further rearward on scope tube 110 such that a portion of the objective lens 130 (or eyepiece lens 120) extends outwardly from the lens ring 160. In this manner, when cover bracket 170 is pivoted to a closed position (similar to that shown in FIG. 5), cover membrane 180 will seat against the terminal end wall of the lens 130 (or 120) and not against front face 162 of the lens ring 160. It is to be understood by those skilled in the art that the lens ring 160 may be disposed rearward upon the scope tube 110 only so far as the elasticity of the cover membrane 180 permits the cover membrane to stretch across the lens 130 (or 120) without tearing the membrane.

Figure 2:
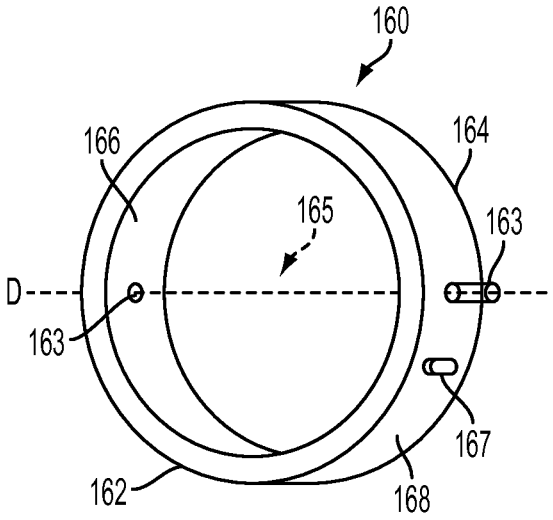
FIG. 2 is a perspective side elevation view of an isolated lens ring used within an embodiment of the invention.

An isolated lens ring 160 is shown in FIG. 2. Lens ring 160 is generally ring-shaped having a front face 162 and rear face 164 whose thicknesses are defined by the distance between inner wall 166 and outer wall 168. Extending outwardly from outer wall 168 is a pair of opposing trunnions 163. In a preferred embodiment, trunnions 163 rest along diameter D of the lens ring 160. Preferably, each trunnion is adapted to sit flush with the surface of inner wall 166 so as to enable substantially the entirety of inner wall 166 of the lens ring 160 to touchingly encircle the lens (i.e. objective lens 130 as shown in FIG. 1). To accommodate lenses of differing diameter, lens ring 160 may be constructed of an elastomeric material, and more preferably is constructed of an elastomeric material which can expand and contract repeatedly without loss of elasticity, and even more preferably of an elastomeric material that can expand and contract to fit lenses having diameters of from about 1.375 inches to about 2.5 inches. One possible example of a suitable elastomeric material is silicone rubber.

With reference to FIGS. 3-5, cover bracket 170 is configured as a generally C-shaped member having a front face 172 and rear face 174 whose thicknesses are defined by the distance between inner wall 176 and outer wall 178. Cover bracket 170 includes opposing trunnion holes 173 which are adapted to be mounted upon and pivotally engage with corresponding trunnions 163 on lens ring 160. Cover bracket 170 preferably includes an extended arm region 175 which travels some distance beyond trunnion hole 173. Extended arm region 175 is more preferably configured so as to provide a thumb engagement feature thereby allowing a user to manipulate the lens cover 150 between an open or closed position.

For proper operation of the lens cover, it is imperative that inner wall 176 of the cover bracket 170 have a radius $R_2$ which is larger than radius $R_1$ of outer wall 168 of lens ring 160. In this manner, when the cover bracket 170 is in an open position (FIG. 3) the cover bracket rests beyond the lens ring 160 with cover membrane 180 gathered between the ring and bracket structures. Preferably, the difference between radii $R_2$ and $R_1$ is minimized so as to decrease, if not eliminate, any obstruction of the user's downfield view caused by the lens cover 150 when in the open position.

As discussed above, lens ring 160 is preferably constructed of an elastomeric material so as to adjustably fit lenses of differing diameter. To accommodate the elastomeric adjustability of the lens ring 160, cover bracket 170 may include a plurality of opposing trunnion holes 173, 173' and 173", for example. Cover bracket 170 has sufficient flexibility which allows extended arm regions 175 to be pulled away from the lens ring 160 so as to disengage trunnions 163 from their respective trunnion holes 173, 173' or 173". Cover bracket 170 also has sufficient resilience such that extended arm regions 175 reengage trunnions 163 once the cover bracket has been selectively positioned by the user. Preferably, cover bracket 170 may be selectively positioned on trunnions 163 so as to cause radius $R_2$ to most closely match radius $R_1$ (with the understanding that $R_2$ is greater than $R_1$ as discussed previously).

In a further preferred embodiment, cover bracket 170 is pivotally affixed to lens ring 160 so as to impart spring-tension within the cover membrane 180 when the cover bracket 170 is in a closed position (i.e. as shown in FIG. 5). That is, cover bracket 170 may include a groove 177 configured to engage with and capture detent 167 on lens ring 160 (see FIG. 2). Extended arm region 175 may be configured to include a further groove 177' which engages with the detent 167 when the cover bracket 170 is in the open position (FIG. 3). Alternatively, detent 167 may be positioned so as to rest below the terminal arm of extended arm region 175 when the cover bracket 170 is in the open position (not shown).

When cover bracket 170 is in the closed position (FIG. 5), cover membrane 180 is stretched to cover ring opening 165. Stretching of cover membrane 180 imparts spring tension within the stretchable polymeric membrane material of cover membrane 180. The spring tension is stored within the cover membrane 180 by engaging groove 177 about detent 167 wherein the interaction between the groove and detent is sufficient to overcome the spring tension such that the cover bracket 170 is releasably secured in the closed position. When sufficient force is applied to the cover bracket (i.e. thumb pressure to extended arm region 175) the groove 177 disengages from the detent 167 thereby allowing the release of the spring tension stored within the stretchable polymeric material of cover membrane 180. Release of the spring tension directs the cover bracket 170 to its open position (FIG. 3).

While the groove and detent elements have been shown and described as the lens ring 160 including detent 167 and cover bracket 170 having groove 177 (and optionally 177'), it is to be understood by those skilled in the art that this arrangement may be reversed such that the lens ring includes one or more grooves and the cover bracket has the detent. It is to be further understood by those skilled in the art that while disclosed as a groove-and-detent arrangement, other suitable retaining arrangements may be utilized, such as but not necessarily limited to opposing magnets, hook-and-loop fasteners and the like.

With continued reference to FIGS. 3-5, cover membrane 180 is comprised of a stretch film material having sufficient durability so as to protect an underlying lens (i.e. objective lens 130) from debris such as dust, dirt and oil, as well as to prevent scratching, chipping or other physical damage to the lens material. Additionally, in a preferred embodiment, cover membrane 180 is comprised of a waterproof or water repellant material. At least a portion of cover membrane 180 is fastened to a corresponding portion of front face 162 of lens ring 160, with substantially the remainder of the cover member fastened to a portion of rear face 174 of cover bracket 170. Through this arrangement, cover membrane 180 is directed so as not to impede ring opening 165 when the cover bracket is in the open position, but allows the cover membrane 180 to cover substantially all of front face 162 when the cover bracket 170 is in the closed position.

In a preferred embodiment, each respective portion of cover membrane 180 that is fastened either to the lens rings

160 or to cover bracket 170 is fastened via a two-shot or multi-shot molding process. Cover membrane 180 may be constructed of any suitable polymeric or non-polymeric material including, but not specifically limited to, polyvinyl chloride (PVC) film, high density or low density polyethylene (HDPE, LDPE) film, polytetrafluoroethylene (PTFE), silicon rubber, and the like. More preferably, cover membrane 180 may be constructed of a clear transparent material such that, should the user choose, the user may view through the firearm scope without first removing the lens cover. Even more preferably, the cover membrane 180 is constructed so as to possess anti-reflective/anti-glare properties which prevent light reflection off of the lens cover which may alert potential targets or reveal the user's location.

Although the invention has been described with reference to preferred embodiments thereof, it is understood that various modifications may be made thereto without departing from the full spirit and scope of the invention as defined by the claims which follow.

What is claimed is:

1. A lens cover for a firearm scope having a scope tube with a lens secured therein, said lens cover comprising:

a) a substantially circular lens ring defined by first and second semicircle segments, said lens ring adapted to be removably mounted to said scope tube adjacent said lens such that lens ring is located radially outwardly of, and does not obstruct viewing through, said lens;

b) a cover bracket defined by a curved segment having first and second opposite ends, said cover bracket pivotally connected adjacent said first and second ends to said lens ring such that said cover bracket is selectively pivotable between open and closed positions with respect to said lens ring with said curved segment positioned radially outwardly of and adjacent to said first semicircle segment when in said open position, and said curved segment positioned radially outwardly of and adjacent to said second semicircle segment of said lens ring when pivoted to said closed position; and c) a flexible cover membrane attached to and extending between said first semicircle segment of said lens ring and said curved segment of said cover bracket, whereby said flexible membrane gathers and folds upon itself between said first semicircle segment of said lens ring and said curved segment of said cover bracket when said cover bracket is pivoted to said open position such that said membrane does not extend over said lens, and whereby said flexible membrane unfolds and extends over said lens and stretches between said first semicircle segment of said lens ring and said curved segment when said cover bracket is pivoted to said closed position.

2. The lens cover of claim 1 wherein said lens ring comprises an elastomeric material so as to enable mounting of said lens ring to scope tubes of differing diameters.

3. The lens cover of claim 2 wherein said elastomeric material is silicone rubber.

4. The lens cover of claim 1 wherein said cover bracket includes a plurality of mounting holes adjacent each of said first and second ends for mounting said cover bracket to said lens ring through a selected one of said mounting holes adjacent said first end and through a selected mounting hole adjacent said second end.

5. The lens cover of claim 1 wherein at least one of said first and second ends of said cover bracket is configured as a thumb engagement portion.

6. The lens cover of claim 1 wherein said cover membrane comprises a stretchable polymer material.

7. The lens cover of claim 1 wherein said cover membrane is configured to include an anti-reflective surface.

8. The lens cover of claim 1 wherein said cover membrane is attached to said lens ring and said cover bracket through a two-shot molding process.

9. The lens cover of claim 1 wherein a) said lens ring further includes a detent;

b) said cover bracket includes a groove adapted to be releasably secured by said detent when said cover bracket is in the closed position; and c) said cover membrane comprises a stretchable polymer material, wherein said cover membrane includes a spring tension stored within said stretchable polymer material when said cover bracket is in the closed position.

* * * * *